US006276501B1

(12) United States Patent
Tong

(10) Patent No.: US 6,276,501 B1
(45) Date of Patent: Aug. 21, 2001

(54) COMPOSITE SUITCASE

(76) Inventor: Joy Tong, 2932 NW. 27th St. Bldg. 14, Ft. Lauderdale, FL (US) 33311

( * ) Notice: Subject to any disclaimer, the term of this patent is extended or adjusted under 35 U.S.C. 154(b) by 0 days.

(21) Appl. No.: 09/640,590

(22) Filed: Aug. 18, 2000

(51) Int. Cl.[7] ..... A45C 7/00; A45C 9/00; A45C 13/10

(52) U.S. Cl. ..... 190/107; 190/113; 190/115; 190/901; 190/903; 206/287.1

(58) Field of Search ..... 190/107, 115, 190/113, 901, 903; 206/287.1

(56) References Cited

U.S. PATENT DOCUMENTS

| | | | | |
|---|---|---|---|---|
| Re. 33,794 | * | 1/1992 | King et al. | 206/287.1 |
| 3,777,862 | * | 12/1973 | Zipper | 190/107 |
| 3,944,032 | * | 3/1976 | Samhammer et al. | 206/287.1 X |
| 5,505,297 | * | 4/1996 | Myers et al | 206/287.1 X |
| 5,566,797 | * | 10/1996 | Van Himbeeck | 190/115 X |
| 5,575,391 | * | 11/1996 | Gerch | 190/115 X |

FOREIGN PATENT DOCUMENTS

| | | | | |
|---|---|---|---|---|
| 844390 | * | 8/1960 | (GB) | 190/113 |

* cited by examiner

*Primary Examiner*—Sue A. Weaver
(74) *Attorney, Agent, or Firm*—Bacon & Thomas PLLC

(57) ABSTRACT

A design of a composite suitcase having an 'n' shape body and a triple-fold extensible member. The triple-fold extensible member being attached to one side of the 'n' shape body. On the periphery of the triple-fold extensible member is provided a zipper chain which is complemented by a counter zipper chain furnished on the edge rim of the 'n' shape body with an opening provided centrally to the middle fold segment of the triple-fold member, overlapped by a liftable lid. The zipper may be sealed to close such that, once the triple-fold member is folded up, the closure by the zipper pair will form a suitcase completed together with the 'n' shape body, whereupon the suitcase may be deployed to store a suit. The suitcase may be opened by opening the lid externally, the opening allowing for the storage of objects therein.

9 Claims, 4 Drawing Sheets

COMPOSITE SUITCASE

BACKGROUND OF THE INVENTION

1. Field of the Invention

The invention relates to a composite suitcase, especially one serving to accommodate hanging deployment of a gentleman's suit therewithin while in transport in addition to fundamental functions expected of a common suitcase.

2. Description of the Prior Art

It is well known to the public that a common suitcase is structured so that one side thereof is executed to be a liftable lid which is sealable with the remaining part of the suitcase by the engaging closure of a rim zipper formed over the periphery of the liftable lid against the correspondent perimeter of the remaining part of the suitcase, in order to put objects into the suitcase, intended to be carried along. The first step is to draw apart the rim zipper about the liftable lid, so that an opening is formed on the suitcase, through which objects may be stowed in one by one, eventually to be carried away personally by the owner. In regard to another model of a suitcase designed specifically for the transport of gentleman's suit, for example, it is essentially adapted to be foldable and deployed in full when containing a gentleman's suit to be brought away by the owner in person, for instance, so that the suit or overcoat or other garments in one description or another, may be laid flat within, the suitcase and is then resumed to its casual fold up condition, and the contents are made ready for carriage from place to place securely and free from crease.

The problem with any of the two prior art models described above is that it serves to apply only in one specific application, that is, with a conventional suitcase its application generally extends only to the stowage of objects, but not for specific garments such as gentleman's suits, for example. In the case of suit-specific suitcases, the stowage applies only to garments, allowing for varied kinds, but not to other objects due to the lack of space or capacity. For users wishing to stow in suits and other objects altogether in a same suitcase the inconvenience is immediate and therefore improvements are needed.

SUMMARY OF THE INVENTION

The primary object of the invention, therefore, is to provide the design of a composite suitcase comprising an 'n' shape body and a triple-fold extension member. The triple-fold extension member being attached to one side of the 'n' shape body. On the periphery of said triple-fold extension member is provided a zipper chain which is complemented by a counterpart zipper chain provided on the edge rim of the 'n' shape body, with an opening provided centrally to the middle fold segment of said triple-fold member, overlapped by a liftable lid, the aforementioned zipper pair may be sealed to closure, such that, once the triple-fold member is folded up, the closure by the zipper pair executed in the meantime will form a suitcase on completion together with the 'n' shape body, whereupon the suitcase may be deployed in full to store in garment, gentleman's suit, for example, casually laid or hung for transport from one place to another. The suitcase may also be opened from the outside so that objects other than garments or suits may be placed within when the suitcase remains open thereby.

A further object of the invention is to provide the design of a composite suitcase whereof an elongation member is added to an edge inside the terminal end of the liftable lid, the elongation member being deployable by overturning from the outside or instead, it may be superposed by folding up internally inside the liftable lid to accommodate laying therein of garments of different lengths, thereby relieving trouble otherwise incurred should the garment to be stored in be overly long or cumbersome way. This feature permits mobile adjustment of what is contained inside the suitcase.

DETAILED DESCRIPTION OF THE PREFERRED EMBODIMENTS

Figure 1:
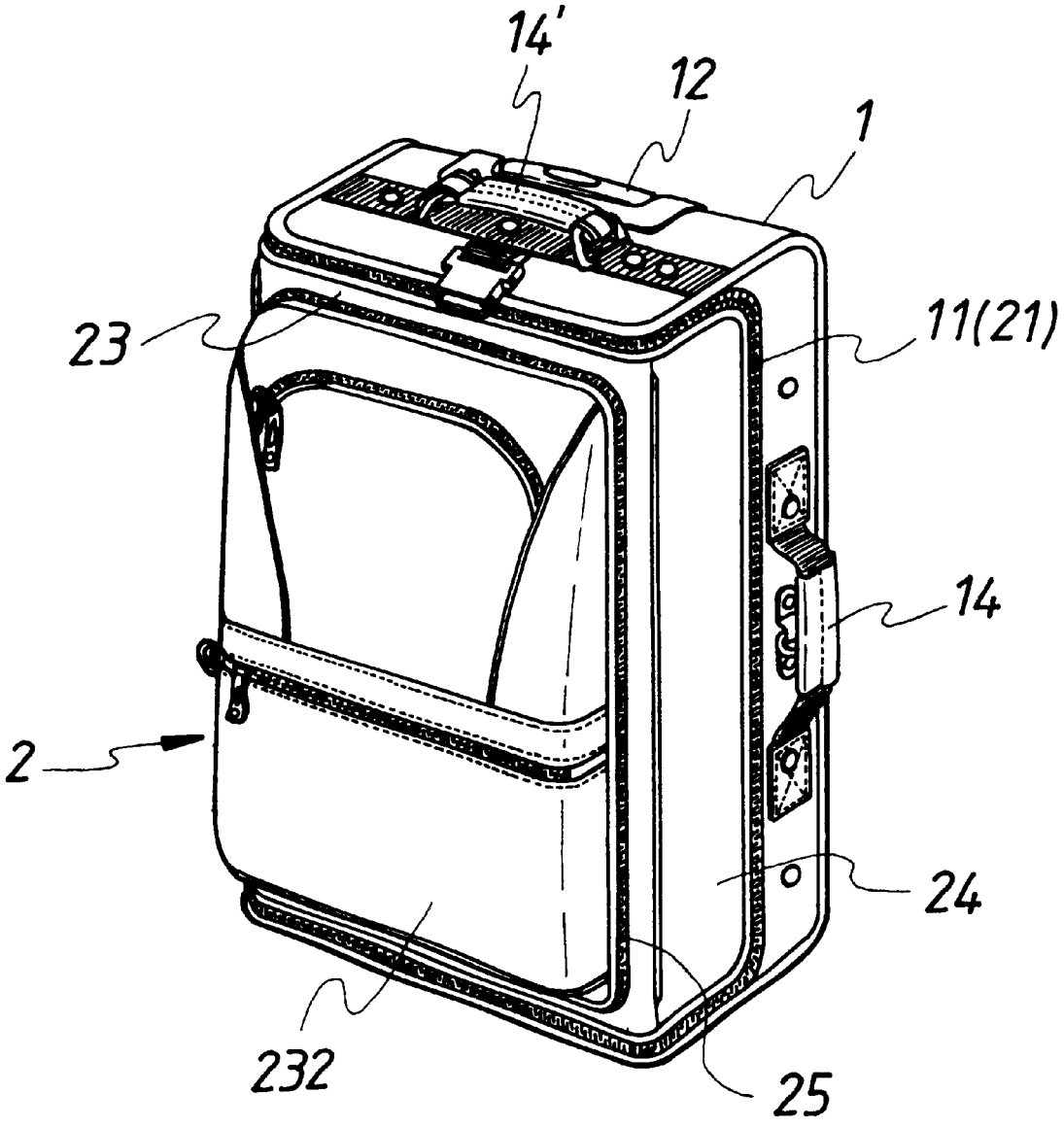
FIG. 1 is a three-dimensional perspective of the invention.
Figure 2:
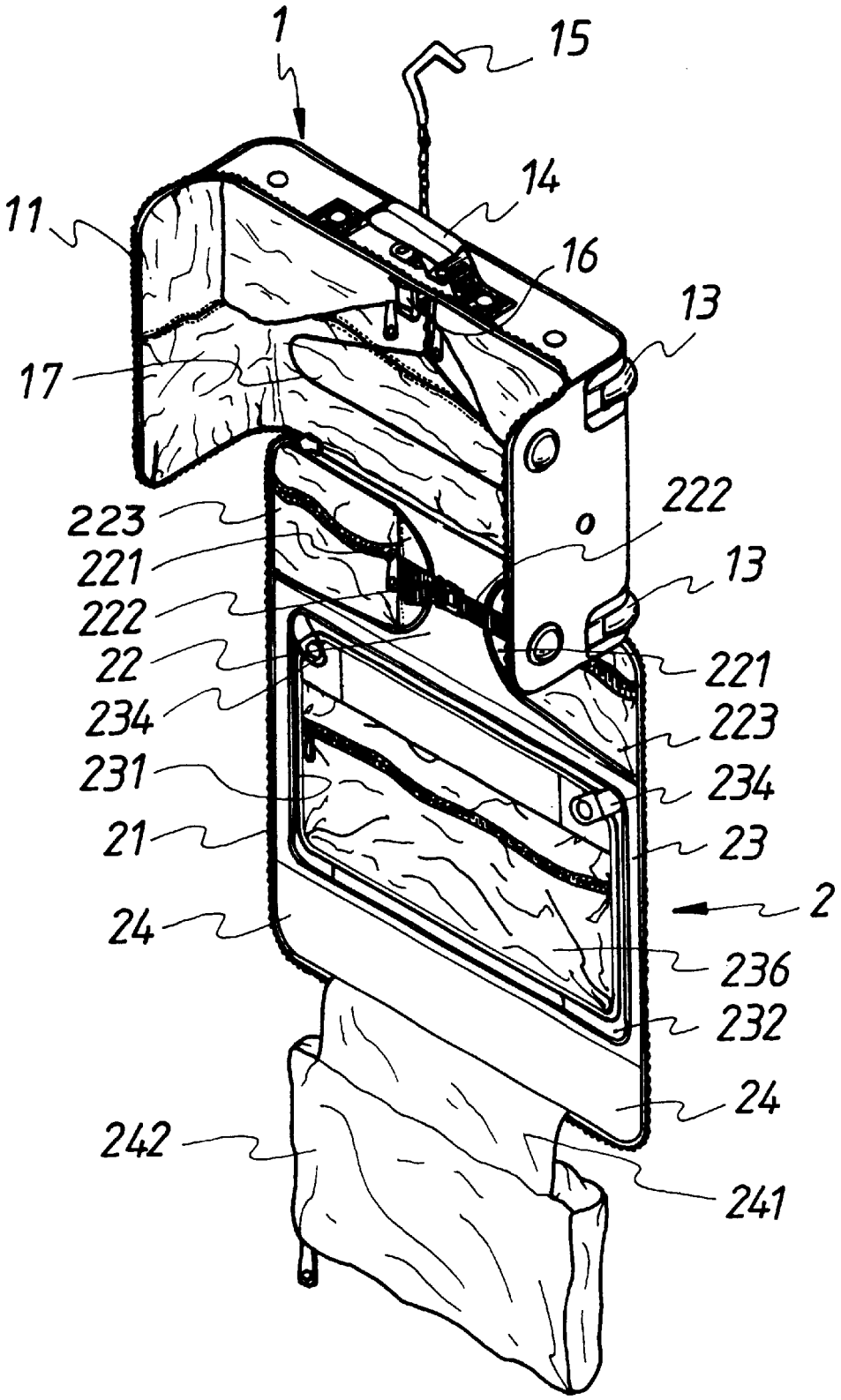
FIG. 2 is an illustration of the invention embodied for use in a fully deployed execution.

As shown in FIG. 1 and FIG. 2, the invention is composed essentially of an 'n' shape body 1 and a triple-fold elongation member 2.

On the outer rim of the 'n' shape body 1 there is provided a zipper 11 on whose outer wall, on both sides, are mounted a lug 12, one set of rollers 13 and a drawbar 14, the lug 12 may be further equipped with an auxiliary drawbar 14' close by, the drawbar 14 may be provided with a removable hanging hook 15, inside that portion of the 'n' shape body 1 underneath said hanging hook 15 there is a hanger fastener 16 to secure the garment hanger 17 in place while active in use.

The triple-fold elongation member 2, attached to one side of the 'n' shape body, 1 has its periphery equipped with zipper 21 which corresponds with counterpart zipper 11 forming part of the 'n' shape body 1, so that, once the triple-fold elongation member 2 is folded up both zippers can be drawn relative to each other so as to form a lateral planking of the suitcase, like what is shown in FIG. 1, with the first segment fold 22 positioned corresponding to the third segment fold 24, a lateral planking of the suitcase takes shape.

On either of both lateral sides of the first segment fold 22 is furnished with a press piece 221. On the terminal end of each press piece 221 is furnished a resilient lacing 222 meant to interlace each other.

Whereas the second segment fold 23 in the middle position is positioned flush with the bottom of the 'n' shape body 1 and with an opening 231 provided centrally, attached to the edge on top of said opening 231 is a liftable lid 232, on the rim of both this opening 231 and the liftable lid 232 is furnished a zipper 25 serving to close the liftable lid 232 onto the opening 231 and seal same to closure, and a movably engaged criss-cross lacing 233 and two lacings 234 are additionally provided on the interior rim of the opening 231.

The third segment fold 24 has a connector 241 linked to its bottom to the terminal end of which it is thereby possible to provide a zipper-bearing pouch 242.

Figure 3:
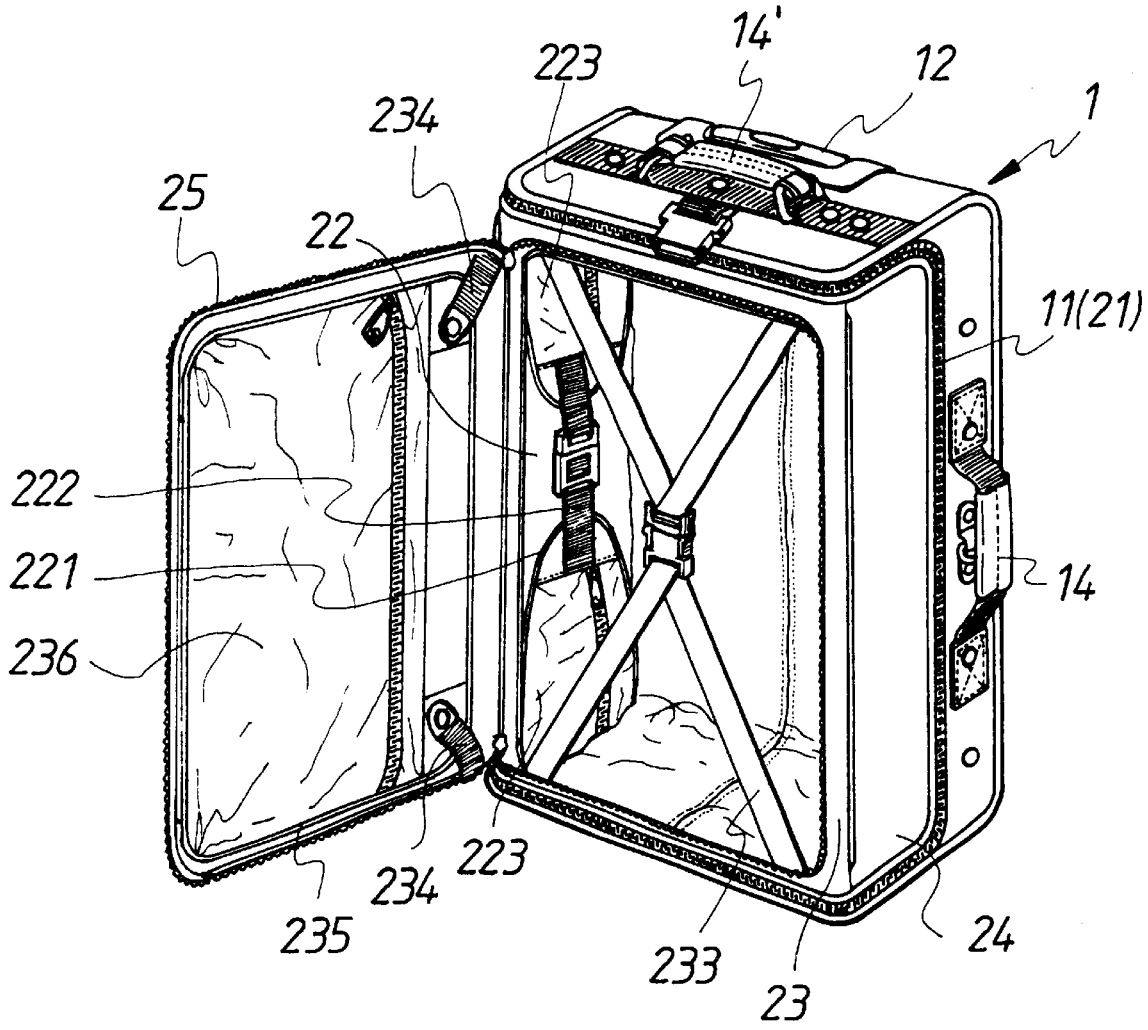
FIG. 3 is an illustration of the invention embodied for use with the liftable lid pulled up to open.

Structured accordingly, the suitcase is to be operated, when put to intended use, by drawing the zipper 25 open so that the liftable lid 232 can open outwardly, and one may proceed to withdraw objects stowed therein, or stow objects thereinto by way of the opening 231, and in this connection the invention serves the purpose of an ordinary suitcase, like what is shown in FIG. 3. When the sealing between zipper 11 and zipper 21 is undone, the suitcase is thereby brought to a fully deployed state ready for hanging use, in this connection serving the purpose of a portable suit carriage, like what is shown in FIG. 2. The design as such effectively expands the scope of application of what is known to be a suitcase to a more versatile suitcase.

Figure 4:
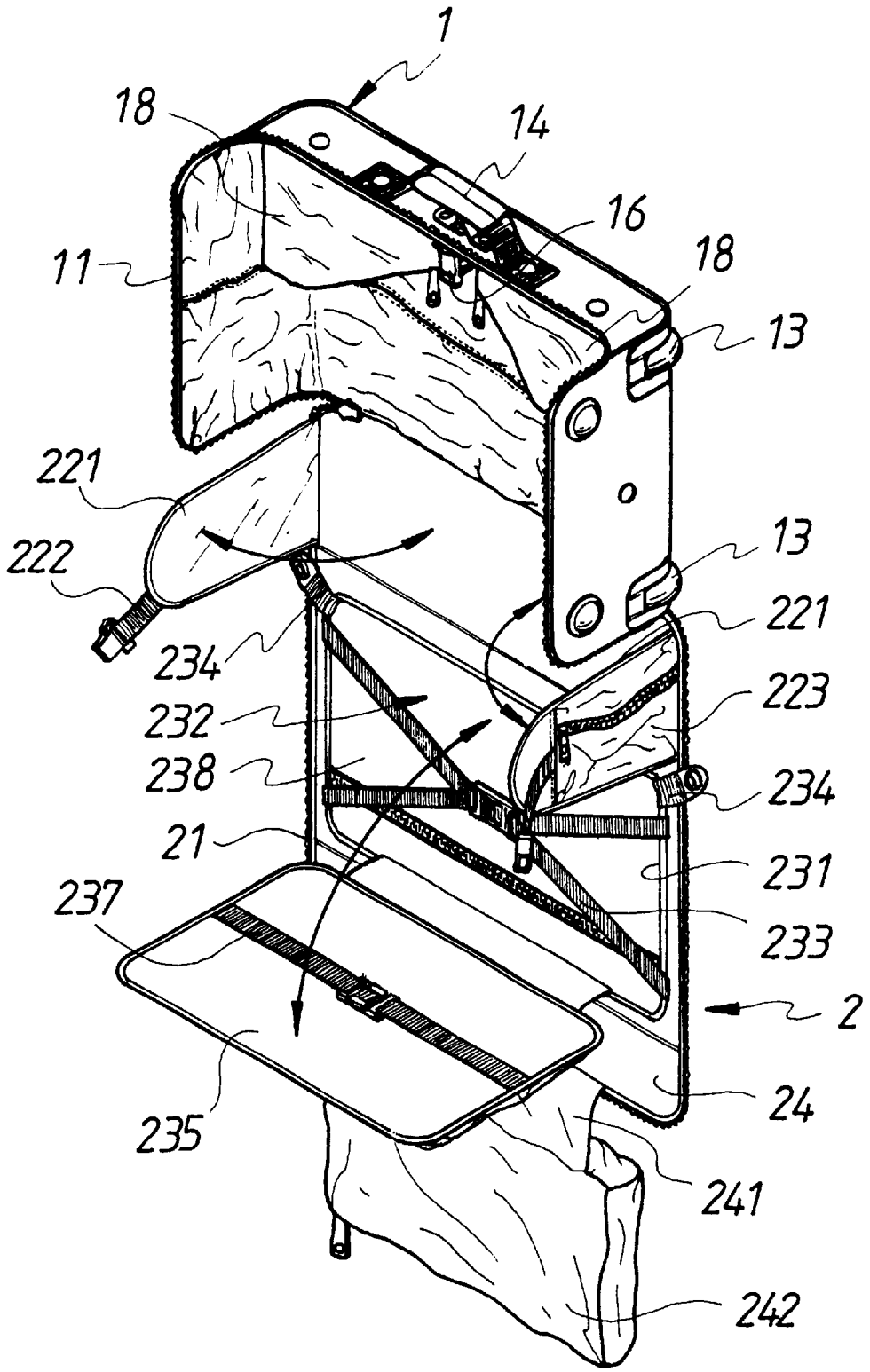
FIG. 4 is an illustration of the invention with the elongation member pulled in full deployment for execution.

Referring to FIG. 4, it is seen that a prolongation member 235 is added to the terminating end of the liftable lid 232, the exterior surface of the prolongation member 235 being integral with a pouch 236 as shown in FIG. 3 or FIG. 4, while the interior face of same is furnished with a spanning lacing 237 centrally, to the effect that as the invention composite suitcase is meant to serve the purpose of an ordinary suitcase, the prolongation member 235 will have to be coupled, that is, adhered to the interior surface of the liftable lid 232 by means of a fastening lacing 234 provided along the inner rim of the openings 231, in order that its intended action will note be hampered when the liftable lid 232 is being lifted to the open position; and once the invention composite suitcase is intended to serve the purpose of a suit or garment carrier, and put to use as such, the prolongation member 235 is deployed in full so that the lower swing of a longer suit or otherwise denominated garment may be held in position by means of the spanning lacing 237. With the binding effects caused by two press pieces 221 and the criss-cross lacing 233, the suit or garment being stowed therein will remain clung to the interior of both the 'n' shape body 1 and the triple fold member 2, so that when, later, as the triple fold member 2 is zipped along the cornered contour of the suitcase to close same in closure, the suit or garment will remain stowed inside free from crease.

Additionally, along the internal comers, either of the 'n' shape body 1, or the liftable lid 232, or on the surfaces either inside or outside the two press pieces 221, there may be attached as expandable pouch 18 or loading bags 238, 223, having web-like texture or PVC tape composition, serving to maximize available space for stowing personal effects. What has been disclosed thus far in the foregoing serves only as a concrete, non-limiting example of the invention, and it is to be noted that all variants, modifications and applications of the invention apparent to persons skilled in the art are all considered not to depart from the principle and teachings according to the invention which is defined in the text and the claims.

What is claimed is:

1. A composite suitcase, comprising an n-shaped body and a triple-fold member; wherein the n-shaped body has outer walls, a first zipper over and along its periphery, a plurality of lugs, a set of rollers and a drawbar provided on two of the outer walls of the n-shaped body;

the triple-fold member is connected with one side of the n-shape body and has at its periphery, a second zipper corresponding with the zipper formed on the body, both zippers in this context forming a combinable pair;

a first segment of said triple-fold member has a press piece furnished on either of both sides thereof, and on a terminating end of each press piece is attached a resilient lacing so that the lacings are interlaced with each other;

a the second segment of the triple-fold member corresponds with a bottom of the n-shaped body, and has an opening provided centrally, on a top edge of said opening is mounted a liftable lid, and on a bordering rim of both said liftable lid and the opening is provided a third zipper;

a third segment of said triple-fold member is positioned symmetrically with the first segment of said triple-fold member to form a corresponding side planking of the body;

once the suitcase is assembled to form all of the foregoing pieces and parts, by folding up the triple-fold member and joining the first and second zippers of the n-shaped body so that an enclosed suitcase is formed allowing the drawing of the zipper on the liftable lid apart so that the lid is available to open outwardly, to permit the withdrawal or storage of objects by way of the opening thus produced, and once a zipper-bound state of the triple fold member is formed with the 'n' shape body, the suitcase can be deployed to accommodate the hanging of garments including gentleman's suits and the suitcase can be used like a mobile wardrobe.

2. The composite suitcase according to claim 1, wherein the lug that is part of the body is incorporated with an auxiliary grip.

3. The composite suitcase according to claim 1, wherein a removable hanging hook is attached near the lug of the 'n' shape body.

4. The composite suitcase according to claim 1, wherein a bottom of the third segment of triple-fold member is attached with a coupling piece whose terminating end incorporates a zipper-bearing pouch.

5. The composite suitcase according to claim 1, wherein a portion of the'n' shape body incorporates a hanger fastener useable in conjunction with a hanger to which garment is to be hung.

6. The composite suitcase according to claim 5, wherein a zipper bearing pouch is furnished on an outside of an elongation member, and an internal side of an elongation piece is furnished with a spanning lacing, at a central point thereof.

7. The composite suitcase according to claim 1, wherein a movably engaged criss-cross lacing and two harness fittings are furnished onto internal rims of said opening.

8. The composite suitcase according to claim 1, wherein an elongation piece is attached to the terminating end of said liftable lid.

9. The composite suitcase according to claim 1, wherein locations including internal recesses of the n-shaped body, inside or outside said liftable lid or the two press pieces, are attached with expandable bags or depository bags having web-like texture or PVC tape composition.

* * * * *